United States Patent [19]

Krieger

[11] Patent Number: 4,688,502

[45] Date of Patent: Aug. 25, 1987

[54] PUFFED EMBROIDERED DESIGN FABRICS

[75] Inventor: David Krieger, Greenville, S.C.

[73] Assignee: Krieger Corporation, Travelers Rest, S.C.

[21] Appl. No.: 854,254

[22] Filed: Apr. 21, 1986

Related U.S. Application Data

[63] Continuation-in-part of Ser. No. 811,780, Dec. 20, 1985.

[51] Int. Cl.[4] ..... D05C 17/00

[52] U.S. Cl. ..... 112/439; 28/158; 28/164; 112/266.1

[58] Field of Search ..... 28/158, 163, 164, 153; 112/266.1, 439, 410

[56] References Cited

U.S. PATENT DOCUMENTS

| | | | |
|---|---|---|---|
| 2,231,388 | 2/1941 | Kahil | 28/158 X |
| 2,401,828 | 6/1946 | Kahil | 28/158 X |
| 2,401,830 | 6/1946 | Kahil | 28/158 X |
| 2,702,463 | 2/1955 | Carter | 28/163 X |
| 2,813,501 | 11/1957 | Shotsky | 112/266.1 |
| 3,195,489 | 7/1965 | Estephanian | 112/266.1 |
| 3,243,861 | 4/1966 | Kumin et al. | 112/410 UX |

FOREIGN PATENT DOCUMENTS

| | | | |
|---|---|---|---|
| 1014766 | 6/1952 | France | 28/164 |

*Primary Examiner*—Robert R. Mackey

*Attorney, Agent, or Firm*—Sprung Horn Kramer & Woods

[57] ABSTRACT

A lightweight embroidered puffed design fabric (10) having puffed design elements (E) formed in a prescribed embroidered design (C) is disclosed. The design fabric includes a front fabric (A) on which the design is formed and a lightweight backing fabric (B). The front and backing fabrics are united by embroidery stitching (14) which forms a preshrink design pattern D for the puffed elements. Backing fabric (B) is a gauze-type fabric which includes a relatively low count of highly shrinkable cotton weft and warp yarns (22, 24) loosely woven to form an open mesh 20 to facilitate full and uniform shrinking of the back fabric relative to said front fabric. Excess in the face of the front fabric forms puffed design elements (30, 32) in a manner controlled by preshrink design pattern D. In accordance with the method, front and backing fabrics are united in composite fabric (11) by embroidering preshrink embroidered pattern (D) on front fabric (A). The embroidered composite panel (**11*b*) is subjected to hot water treatment in a manner and temperature that the back fabric shrinks relative to the front fabric forming the puffed design elements. Finally, the shrink embroidered composite panel (11**) is placed in a commercial tumble dryer and dried in a relaxed, untensioned state in a manner that the puffed design elements and puffed embroidered design are thermally stabilized in the fabric. A reversible structure can be provided by sandwiching the backing fabric between two front fabrics.

8 Claims, 11 Drawing Figures

Fig. 1.
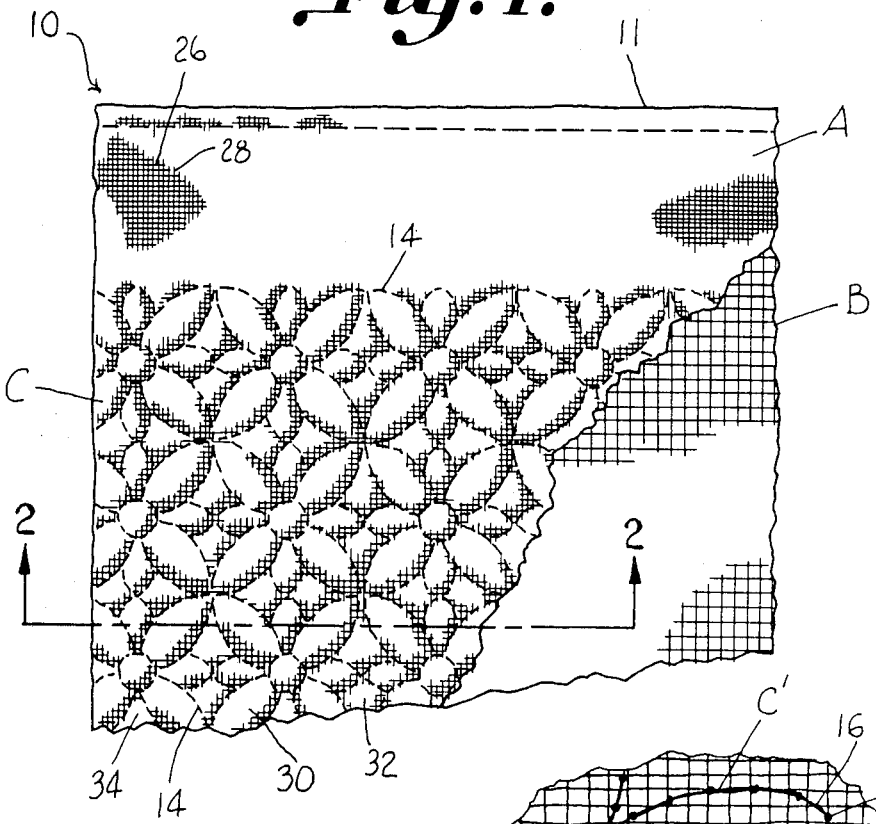
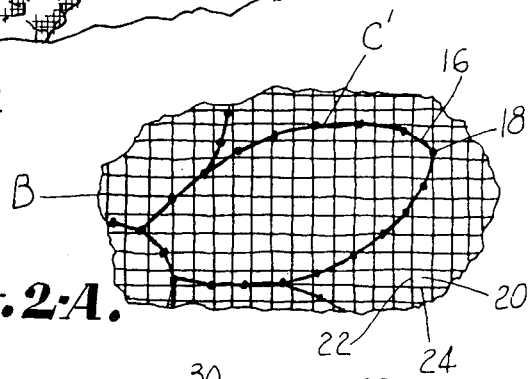
Fig. 2A.
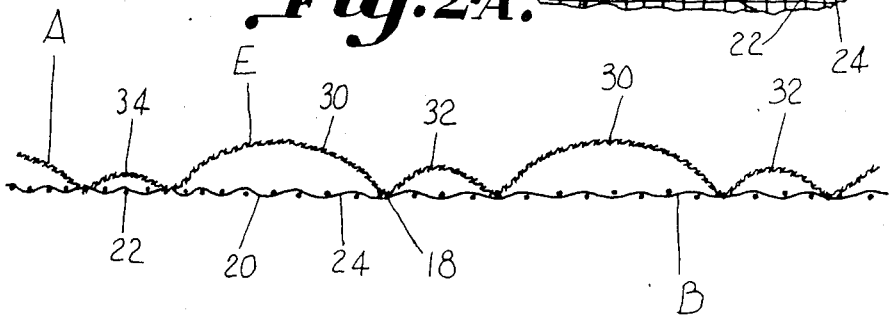
Fig. 2.

PUFFED EMBROIDERED DESIGN FABRICS

This application is a continuation-in-part of application Ser. No. 811,780, filed Dec. 20, 1985, now pending.

BACKGROUND OF THE INVENTION

The invention relates to a fabric which exhibits a puffed design effect and method for the same. More particularly, the invention relates to the provision of a lightweight puffed embroidered design fabric and method by which a multitude of different designs may be created on fabrics by forming puffed design elements in a controlled manner according to prescribed embroidered patterns. The puffed embroidered fabric designs are relatively unlimited in their variety, and according to the fabric and method of the present invention, may be made on a commercial basis in large quantities.

Heretofore, fabric designs have been created which are commonly referred to as three-dimensional, or puckered, fabric designs. The three-dimensional or puckered effect in the fabric design may be accomplished in a number of ways. For example, single ply fabric may be woven or knitted with areas of the fabric provided with yarns that are more shrinkable than the remaining yarns in desired areas. The shrinkable yarns are subjected to shrinkage by either hot washing, chemical, or other treatment, causing a swelled area in the fabric and a patterned effect such as in U.S. Pat. Nos. 2,738,566 and 3,071,165.

U.S. Pat. No. 3,359,610 discloses a patterned puckered fabric achieved by weaving two plies of fabric together with an elastic yarn. The elastic yarn which joins the two plies of fabric together is shrunk creating puckering at the outer layer.

Puckered or three-dimensional design fabrics have also been formed by simultaneously weaving two plies, and interweaving at spaced intervals, one of the plies, which may be shrunk, with the other ply which is not shrinkable. When the shrinkable ply shrinks, small wrinkles or puckers will form in the unshrinkable layer as taught by U.S. Pat. No. 2,231,388. Puckered two-ply fabrics have also been made in which puckering of the fabric is obtained by selective shrinking of certain of the threads of the woven two-ply fabric rather than shrinking one ply and not shrinking the other as described above. Such a fabric is shown in U.S. Pat. No. 2,401,829 wherein shrinkable warp or weft threads are interwoven between two fabric plies to form small puckers. However, the design possibilities in such fabrics are very limited due to the fact that the puckering pattern is established by interweaving two plies at selected points. Thus the designs are limited by the nature of the weaving process itself, and also by the fact that only certain types of designs with little or no variations may be created in this method. The creating of designs by weaving and interweaving two plies is a very time consuming and expensive process which is not commercially attractive. Moreover, the weight of the fabric produced by interweaving two plies results in fabric which has only very limited use and may not be used where a lightweight puckered fabric may be needed. The two-ply fabrics are typically dried on a tenter frame under tension which may take out shrinkage, particularly in the crosswise dimension of the fabric owing to the tensioning of the fabric between the tenter fames. Thus the puckered pattern is not easily varied or determined by the weaving or the drying of the two-ply fabric in the prior art methods and fabrics.

U.S. Pat. No. 3,195,489 discloses a three-dimensional patterned fabric in which an outer layer is made from an elastic material and sewn onto a base layer. The two fabrics are then stretched and a design pattern is stitched to the stretched panels. Afterwards, the tension is released causing the stretched panel to contract and exhibit a pucker in the outer fabric layer. The ornamental fabric is mainly suitable for women's articles of clothing, namely swimsuits in which elastic panels are desired.

Accordingly, an object of the present invention is to provide a method in which a wide variety of puffed designs may be created in a lightweight fabric.

Another object of the invention is to provide a puffed embroidered design fabric and method wherein a wide variety of embroidered designs can be created in the face of fabric which exhibit puffed design elements according to a prescribed well-controlled pattern.

Still another object of the invention is to provide a puffed embroidered design fabric and method wherein a pattern of puffed elements is created in the embroidered design and the resultant fabric is lightweight and suitable for wearing apparel and other lightweight fabric applications.

Another object of the invention is to provide a puffed embroidered fabric and method which are well adapted to the production of a multitude of different designs on a commercial basis.

Still another object of the invention is to provide a puffed embroidered design fabric and method wherein an embroidered pattern is stitched into a front fabric and a lightweight cotton gauze back fabric uniting the fabrics by interlocked embroidery stitches which control formation of puffed design elements in the embroidered pattern upon washing and drying of the fabric.

Yet another object of the invention is to provide a reversible fabric puckered and/or puffed on both faces in a predetermined pattern, as well as a method of making such a fabric, particularly on an embroidery machine.

SUMMARY OF THE INVENTION

The above objectives are accomplished according to the present invention by providing an embroidered puffed fabric having puffed design elements formed on the face of the fabric arranged in a puffed embroidery design. The fabric comprises a front fabric, a woven back fabric united with said front fabric, and a first embroidery yarn embroidered into the front fabric to form a preshrink design pattern. A second yarn is interlocked on the back side of the back fabric which holds the first yarn in place and unites the front and back fabric at points of interlocked stitching whereby the second yarn assumes a pattern corresponding generally to the preshrink design pattern on the face of the fabric. The back fabric is a lightweight fabric having a higher shrinkage rate than the front fabric, and a lower thread count to facilitate substantial differential shrinkage between the back and front fabrics. The back fabric is shrunk relative to the front fabric in a manner that puffed design elments are formed by the excess in the front fabric within the stitchings of the first embroidery yarn. The puffed design elements within the embroidery yarn of the design pattern create a puffed embroidered design on the face of the fabric after shrinkage. The puffed embroidery design on the face of the fabric is reduced in size, but relatively undistorted from the preshrink design pattern. In a preferred embodiment, the front fabric is a polyester/cotton blend, and the back fabric is a lightweight gauze fabric woven from 100% cotton. The back fabric is a very loose weave and shrinkable whereby the weft and warp yarns of the back fabric may undergo full and uniform shrinkage in both warp and weft directions forming puffed design elements well-controlled by the preshrink pattern to create a design relatively undistorted. In accordance with the method, the embroidered fabric is washed in an agitating type washing process and then tumbled dried in a relaxed, untensioned state whereby the puffed design elements are set by heat, and the puffed embroidered design is stabilized so that no further shrinkage occurs during utilization of the fabric.

In accordance with another embodiment of the invention, the backing fabric is sandwiched between two front or facing fabrics and the three-layer laminate is stitched together. Upon shrinking of the intermediate backing fabric a puckered effect is achieved on both faces, the fabric thus being reversible.

Advantageously, the stitching is effected on an embroidery machine utilizing two yarns to form the pattern. Usually the visual effect on the two faces of an embroidered fabric will be different, the yarn on the front establishing the design and the yarn on the back essentially merely locking the front yarn stitches in place. With reversible fabrics in accordance with the invention, the first and second yarns may be more or less balanced so that the designs and puffed effect will be substantially the same on both faces or different, as desired.

The two facing fabrics and the two yarns can be of the same or different colors for a multiplicity of visual effects.

As stated hereinabove, the fabrics are preferably woven although theoretically knit or non-woven layers might be used. They are less preferred, however, since they tend to be less stable and thus would adjust to shrinking tensions and not produce the desired puff. The woven fabrics used can be conventional with the back or backing fabric having of the order of 10 to 15% shrinkage in all directions, i.e. a 45 inch laminate subjected to the instant processes may end up about 39 inches in width after shrinkage, with a similar shrinkage in length.

It is an advantage of the invention that the stitching yarns need not be of the more expensive pre-set type usually employed in embroidery. Instead less expensive unset yarns can be used and their normal shrinkage of about 6 to 7% upon washing will merely contribute to the instantly desired effect. Thus inexpensive textured polyester yarns are suitable and even preferable in carrying out certain embodiments of the invention.

In practive it has proven desirable to take steps to ensure that there is no slippage between the fabric going through the stitching process on a conventional embroidery machine. To this end it is advantageous to stitch the layers together lightly along their selvages.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein several examples of the invention are shown and wherein:

FIG. 1 is a front plan view illustrating a puffed embroidered design fabric with the front fabric cut away to illustrate the back fabric which undergoes shrinking;

FIG. 2 is a sectional view taken along line 2—2 of FIG. 1;

FIG. 2*a* is a back plan view illustrating interlocking embroidery stitching on a shrinkable back fabric according to the invention;

DESCRIPTION OF A PREFERRED EMBODIMENT

Figure 3:
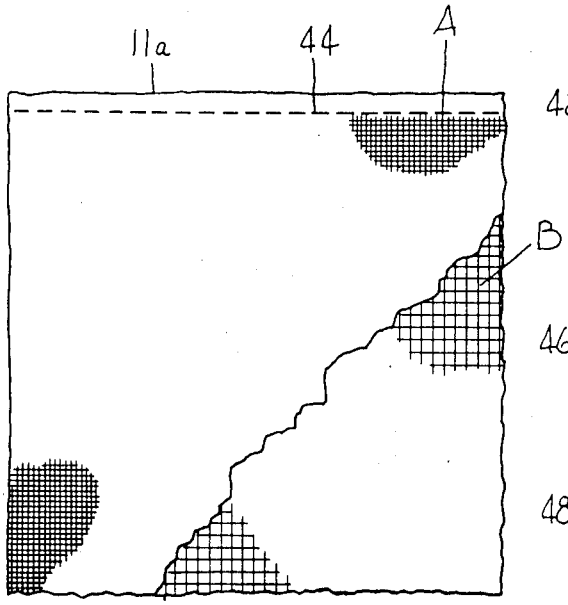
FIG. 3 is a top plan view illustrating a composite fabric and panel consisting of front and back fabrics attached prior to embroidering a desired pattern on the face of the front fabric.

Referring now in more details to the drawings, as can best be seen in FIG. 1, a lightweight, puffed embroidered design fabric is illustrated generally at 10 which includes a composite fabric and panel 11 consisting of a front fabric A and a lightweight back fabric B. A puffed embroidered design C is formed on the face of front fabric A. A first embroidery thread 14 forms embroidery stitches which unite front fabric A and back fabric B. A second thread 16 interlocks with stitches 14 at points 18 in conventional embroidery stitching on the backside of back fabric B (FIG. 2A).

Front fabric A is a woven fabric which is woven in a very close-weave mesh consisting of a large count of warp and weft yarns. Back fabric B is a very loosely woven fabric woven in a relatively large open mesh 20. The weft yarns 22 and warp yarns 24 woven in back fabric B are relatively uncrimped in the back fabric and are loose. The large open mesh 20 and loosely woven warp and weft yarns enable the back fabric B to have a full and uniform shrinkage in both the warp and weft directions. For this reason, warp 24 and weft yarn 22 are chosen to have a high shrinkage rate. Warp yarns 24 extend lengthwise in fabric 10, and weft yarns 22 run crosswise in fabric 10. Warp yarns 26 and weft yarns 28 woven in front fabric A are very tightly woven in a very close mesh. Thus, there is very little room for the warp and weft yarns of the front fabric to move in even if the yarns were shrinkable.

Figure 4:
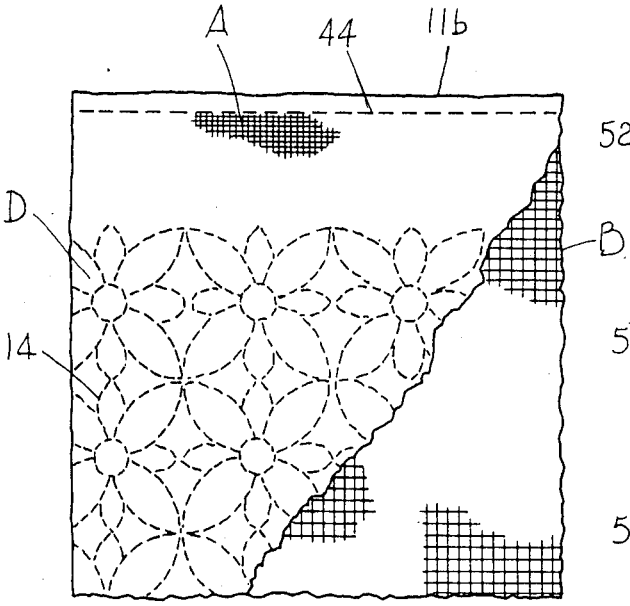
FIG. 4 is a top plan view illustrating the composite fabric and panel of FIG. 3 after a desired embroidered pattern has been formed on the face of a front fabric.

A first preshrink design pattern D is formed by embroidery stitching 14 on the face of fabric A (FIG. 4).

After fabric 10 is shrunk in hot water, the back fabric B undergoes a substantial amount of shrinkage relative to front fabric A due to the looseness and higher shrinkage rate of warp yarns 24 and weft yarns 22, and the openness of mesh 20 of fabric B. In practice, back fabric B is preferably a lightweight cotton gauze fabric woven with warp and weft yarns of 100% cotton, while fabric A is woven from polyester/cotton yarns. Thread count of fabric B is considerably lower than fabric A.

Gauze fabric as used herein means gauze fabrics in the conventional sense and includes those fabrics having a thread count generally below that of voille and print cloth which have a yarn count generally above 100 warp ends and weft picks per square inch. In a broad sense, gauze fabric means a lightweight fabric having a plain weave construction wherein the warp and weft yarns are loosely laid in the weave and are generally uncrimped. In this manner of weave, shrinkable weft and warp yarns may shrink to their fullest possible extent. The gauze fabric is also broadly characterized by its mesh size and open area of its mesh. The dimension of the mesh in the warp and weft direction is substantially greater than the diameter of the warp and weft yarns themselves. Upon shrinkage of the gauze fabric, ample mesh is afforded for shrinking. The mesh space may be on the order of at least two or three times the yarn diameter.

The above gauze fabrics are characterized as a lightweight, open mesh, loosely woven fabric woven in a plain weave including cheese cloth. The fabric is further characterized by yarns having a weight of about 6 ozs. or less and a total count of approximately eighty-five or less warp ends and weft picks per square inch. For example, cotton gauze fabric having thread counts in the range of $44\times36$ to $20\times12$ have been found highly suitable. These gauze fabrics have a thread count ratio of about 1:2 to suitable front fabrics. The gauze may be woven from spun 100% cotton yarns having weights in the thirties (warps) and forties (weft). The projected open mesh area of such the fabric is above 50% of the total fabric area and may be somewhere on the order of 75%.

The stitchings of thread 14 may be from about one-eighth of an inch or on the order of about double the mesh size of the gauze fabric. Embroidery threads 14 and 16 may be any suitable thread such as polyester, polyester/cotton, or cotton.

After shrinkage, fabric 10 exhibits puffed elements E in embroidered pattern D due to substantially full and uniform weft and warp shrinkage of back fabric B causing points of interlocked embroidery stitching 14 in pattern D to move closer together creating excess fabric within embroidered pattern D in front fabric A (FIGS. 1 and 2). In the puffed embroidery floral design illustrated in FIG. 1, it can be seen that large puffed petal elements 30 and small puffed petal elements 32 are created. Puffed loose fabric is created at 34. Due to the full and uniform shrinkage of back fabric B in both warp and weft directions without restriction or tension, embroidered design pattern D is reduced somewhat in size after shrinkage, but is relatively undistorted in the creation of puffed embroidered design C, as can best be seen by comparing FIGS. 4 and 1. Thus, a substantially identical replica of embroidered design pattern D may be achieved in fabric design C after shrinkage and creation of puffed elements E.

Referring now to FIGS. 2 and 2*a*, it will be noted that mesh 20 of back fabric B has a dimension in both the warp and weft directions which is considerably greater than the cross-sectional dimension or diameter of the weft and warp yarns. This facilitates full, uniform, and tension free shrinkage of the yarns in fabric B in the lengthwise and crosswise directions of the fabric corresponding to warp and weft directions. As can best be seen in FIG. 2A, second thread 16 forms a generally continuous pattern C′ which conforms to pattern C on the face 12.

Figure 6:
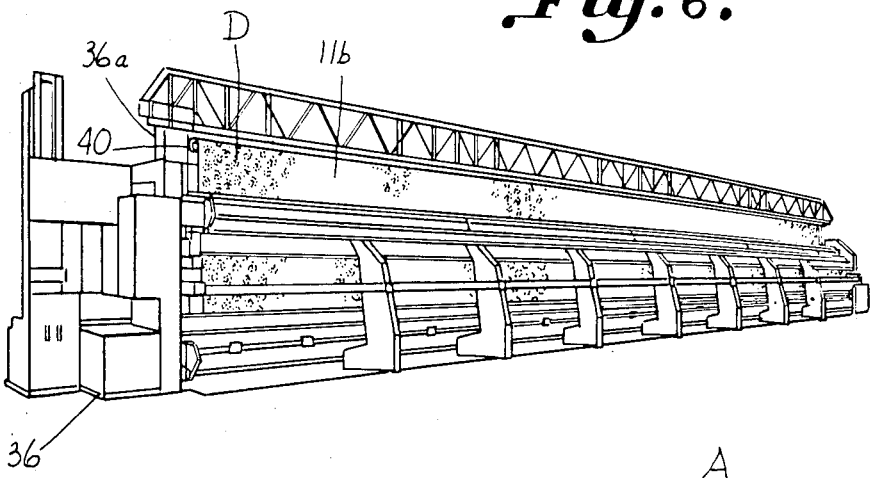
FIG. 6 is a perspective view illustrating a Schiffli embroidery machine for embroidering a composite fabric and panel for forming a puffed embroidered design fabric according to the present invention.

Referring now to the drawings, the method of the invention will be described in more detail. In FIG. 6, a Schiffli embroidering machine 36 is illustrated which is utilized in the method of the present invention. The Schiffli embroidering machine is, almost by necessity, preferred for embroidering the fabric of the present invention prior to shrinkage on a commercially acceptable basis. Composite panel 11*a* must be lightweight in order that it may be embroidered on a frame of the Schiffli machine. The method of the present invention incorporates embroidering from such a machine in such a manner that the puffed embroidered design fabric of the invention can be commercially made in large quantities and in a multitude of different and true designs. This makes the puffed design fabric of the invention pleasing in appearance, desirable, and practical. The Schiffli embroidering machine 36 includes a frame on which panel 11*a* is placed. Panel 11*a* is about twenty-one yards in length and forty-five inches in width. Panel 11*a* is formed by stitching front fabric A and back fabric B together along their selvages. Consecutive panels 11*a* may be sewn together side-to-side and wound upon the top roller 40 and bottom rollers (not shown) of machine 36 in a conventional manner. The needle of the embroidering machine is inserted from face 12 of front fabric A into front fabric A and back fabric B creating a loop in the embroidery yarn 14. While the needle is inserted through fabrics A and B forming the lock stitch loop, second thread 16 passes through the loop forming the interlock stitch 18 (FIG. 2A). A multitude of different designs may be produced in commercially practical quantities in accordance with the method of the invention as will be described in more detail hereafter.

Figure 5:
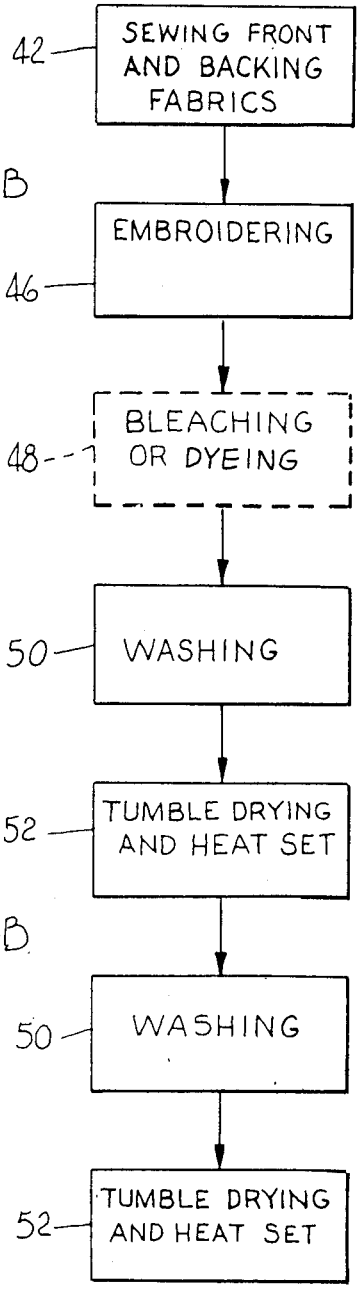
FIG. 5 is a flowchart illustrating a method for creating a puffed embroidered fabric according to the present invention.

Referring now to FIG. 5, a flowchart of the method of the present invention is illustrated wherein the first step 42 includes constructing elongated panel 11*a* of lightweight composite fabric 10 by sewing selvages 44 of front panel A and back panel B together, only one selvage of which is shown in FIG. 3. Elongated panel 11*a* is approximately twenty-one yards in length and forty-five inches in width. Next, at step 46, the composite panel 10 is placed on the frame of embroidery machine 36 and prescribed embroidery pattern D is stitched onto the face of the front fabric A interlocking with back thread 16 on the back side of fabric B. The back thread 16 will form a pattern which corresponds generally to the embroidered design pattern D through being interlocked therewith.

In practice, the panel of fabric B may be slightly narrower in width, about two inches, than the panel of fabric A. This allows for the fabric A to be slightly tensioned on the frame of embroidery machine 36 without stretching fabric B during embroidery. Thus, the shrinkage capability of fabric B is not effected in the shrinkage step.

After embroidering pattern D into the composite panel 11*a*, composite embroidered panel 11*b* is removed from the embroidery machine.

Step 48 is optional and includes bleaching or dyeing the embroidered panel if desired. After embroidered composite panel 11*b* is removed from the embroidery machine, the embroidered composite panel 11*b* is subjected to washing in an industrial type washing machine where tumbling or agitation occurs in hot water in a manner that back fabric B shrinks relative to front fabric A causing excess fabric A to form puffed elements E within embroidery stitches 14 of pattern D. The pattern D is somewhat drawn in due to the stitches of thread 14 being interlocked at points 18 with shrunk back fabric B and back thread 16. The pattern D forms puffed design elements E in a well-controlled and uniform manner to create puffed embroidered design C on the face of front fabric A. Puffed embroidered design C is a reduced and generally undistorted replica of preshrink pattern D.

Next, at 52, the shrunk composite panel with puffed design elements E and puffed embroidered design C on its face is subjected to heat treatment wherein the puffed elements and puffed embroidered design may be heat-set. The heat-setting preferably takes place in a commercial tumble dryer wherein the fabric is dried by tumbling in heated air in a relaxed state without tension, and heat-set at a desired temperature. The heat-set temperature will be that temperature which is above the heat-set temperature of the yarns of the front fabric A. By heat-setting the fabric, the puffed design elements E and puffed embroidered design C in the face of fabric 10 will be thermally stabilized and set so that upon further washing of the fabric after conversion, no further shrinkage will occur. The puffed design elements E and puffed embroidered design C will be set and not lost through further washing of the fabric after converting of fabric 10 to an article of clothing, or household goods such as tablecloths or draperies.

Figure 7:
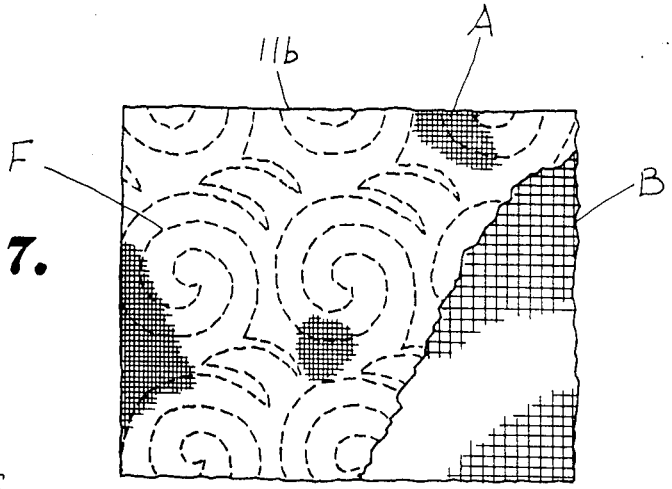
FIG. 7 is a top plan view illustrating a different embroidered pattern formed on a fabric in accordance with the present invention before shrinkage and puffing of the embroidered pattern.
Figure 8:
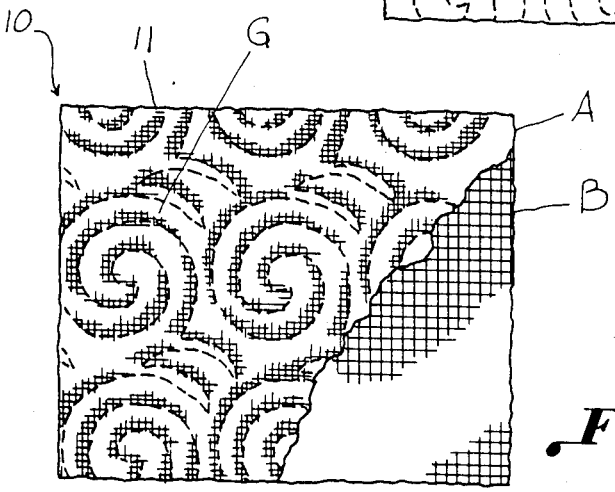
FIG. 8 is a top plan view of the fabric of FIG. 7 after the embroidered pattern has been puffed by shrinkage to create a different puffed embroidered design fabric.

FIG. 8 shows a different puffed embroidered design fabric made in accordance with the instant invention wherein a different preshrink embroidered pattern F (FIG. 7) is made on a composite fabric 10 consisting of front fabric A and back fabric B. The fabric is made into a panel and embroidered as in the steps 42 and 46 above, and subjected to washing and drying as in steps 50 and 52 whereupon differential shrinkage occurs and a puffed embroidered design G is created. In this case, a spiral design is created rather than a floral design, thus illustrating a different design in accordance with the present invention, and that multiple different designs of puffed embroidered design fabric can be had in accordance with the present invention limited only by the design capabilities of the Schiffli embroidery machine 36, which are virtually unlimited.

Figure 9:
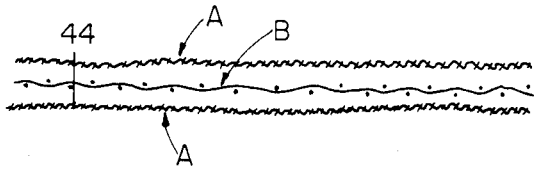
FIG. 9 is a schematic sectional view through a three-layer structure, prior to embroidering suitable for producing a reversible fabric.
Figure 10:
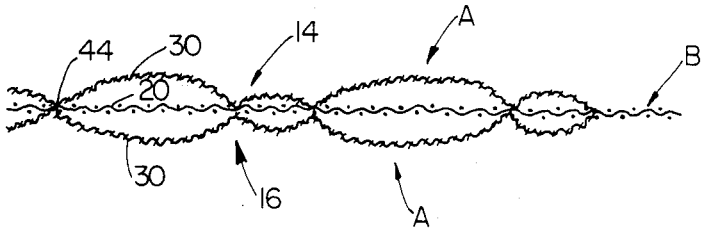
FIG. 10 is a schematic sectional view through the structure of FIG. 9 after embroidering and shrinking.

In FIG. 9, there can be seen a three layer laminate prior to embroidering, made up of two front or facing fabrics A and an intermediate shrinkable backing fabric B, all sewn together near selvages 44 (only one selvage being shown). After embroidering as in the embodiment with only one facing fabric, both faces will have substantially the same appearance as in FIGS. 4 and 7 and, after shrinking, each face of the structure will have an appearance as in FIG. 1. In section, howver, the structure will differ from FIG. 2, as can be seen in FIG. 10.

If threads 14 and 16 are more or less equal in length in establishing the embroidered pattern, the faces will be substantially the same. However, different lengths of each can be utilized and the visual effect on both surfaces will differ. As noted, the yarns 14, 16 and face fabrics A can be varied in color to enhance the differences.

The invention will be further described in the following illustrative examples.

EXAMPLE 1

Front fabric A is a woven polyester/cotton blend fabric (65/35) woven from polyester/cotton yarns with a thread count of 88/64, i.e. 88 threads per linear inch in longitudinal direction and 64 threads per linear inch in transverse direction. Back fabric B is a gauze fabric woven from 100% cotton warp and weft yarns with a thread count of 44/36. The embroidery threads 14 and 16 are polyester. The wash temperature is approximately 175° F., and the drying temperature is approximately 225° F. Two wash cycles and two drying cycles are utilized at the above washing and drying temperatures to fully shrink and heat-set the above fabric.

It has been found in accordance with the invention that two wash and drying cycles are desirable for full shrinkage and full pattern development. The composite fabric panel 11 is shrunk in width from 45 inches to 39 inches and similarly longitudinally, for a shrinkage of approximately 13%. In this case, fabric illustrated at 10 was produced having the puffed embroidered design illustrated at C.

A shrinkage of zero to three percent in front fabric A, and shrinkage of 15% to 20% in back fabric B is preferred. A differential shrinkage of the back fabric relative to the front fabric of between 13% and 15% is preferred in order to achieve the desired fullness of the puffed design elements and overall aesthetic appearance of the puffed embroidered design on the fabric.

While variations may be made without departing from the scope of the invention, the use of a 100% cotton gauze fabric in the method and construction of the fabric as back fabric B is highly desirable. The cotton gauze not only gives a feel of lightness to the composite fabric, but also gives a smooth and light hand to the back side of the fabric when utilized as wearing apparel which is comfortable against the body. However, most importantly is the fact that the 100% cotton gauze fabric, according to the shrinkability of the cotton yarns and looseness and openness of the mesh, draws the embroidery stitches in uniformly in a well-controlled manner to provide full puffed elements without distorting the original embroidered pattern embroidered on the fabric before shrinking. In this regard, it is believed that the back thread 16 also enhances the full and uniform puffing in the final design since any interlock stitches 18 which may not catch the open weave back fabric B will catch the back thread 16 tending to draw in all interlock points together upon shrinkage of the back fabric facilitating uniform pattern reduction of the face fabric.

EXAMPLE 2

The process of Example 1 is repeated except that the backing fabric B is sandwiched between two face fabrics A, as described. The embroidery yarns 14, 16 are textured polyester filament yarns which undergo about 6% shrinkage in the course of the thermal treatments to which they are subsequently subjected. The final product on each face A has the appearance shown in FIG. 1 and in schematic section has the appearance shown in FIG. 10.

While a preferred embodiment of the invention has been described using specific terms, such description is for illustrative purposes only, and it is to be understood that changes and variations may be made without departing from the spirit or scope of the following claims.

I claim:

1. A lightweight stabilized embroidered puffed fabric having puffed design elements formed on the face of the fabric and arranged in a puffed embroidery design comprising:

a front fabric, a woven lightweight backing fabric united with said front fabric, a first embroidery yarn embroidered into said front fabric to form a preshrink design pattern, a second yarn remote from said front fabric holding said first yarn in place and uniting said front and backing fabrics at points of interlock stitching between said first and second yarns whereby said second yarn assumes a backside pattern corresponding generally to said preshrink design pattern, said backing fabric having a higher shrinkage rate that said front fabric facilitating substantial differential shrinkage, said backing fabric being shrunk relative to said front fabric in a manner that puffed design elements are formed by excess fabric in said front fabric corresponding to the stitchings of said preshrink design pattern to create a puffed embroidered design on the face of said front fabric which is relatively undistorted from said preshrink design pattern, the initial shrinkages of the front and backing fabrics differing by up to about 20%, which difference is exhibited in the puffed design, said first and second yarns having been shrunk relative to their initial lengths and thereby enhancing the full and uniform puffing of the design.

2. The fabric of claim 1 wherein said backing fabric consists of a loosely woven open mesh gauze-type fabric having weft and warp yarns of 100% cotton.

3. The fabric of claim 1 wherein said front fabric is a polyester/cotton fabric woven from polyester/cotton yarns and said backing fabric is a cotton gauze fabric woven from 100% cotton yarns.

4. The fabric of claim 1 wherein said backing fabric is characterized by having a count generally less than eighty-five warp yarns and weft picks per square inch.

5. The fabric of claim 1 wherein said backing fabric is a cotton gauze gabric having a thread count in the range of about 44×36 to 20×12.

6. The fabric of claim 1 wherein said front fabric has a thread count ratio of at least about 2:1 to said backing fabric.

7. The fabric of claim 1, including a second front fabric, the first and second front fabrics being on opposite sides of the backing fabric, the first yarn forming a predominant embroidery pattern on the first front fabric and the second yarn forming a predominant embroidery pattern on the second front fabric, puffed embroidery design being formed corresponding to the embroidery pattern on both front fabrics.

8. The fabric of claim 1, wherein the embroidery yarns are textured polyester.

* * * * *